United States Patent [19]

Peter et al.

[11] Patent Number: 5,052,923

[45] Date of Patent: Oct. 1, 1991

[54] OVEN FOR PARTIAL HEAT TREATMENT OF TOOLS

[75] Inventors: Wolfgang Peter, Emmerich; Bernd Edenhofer, Kleve, both of Fed. Rep. of Germany

[73] Assignee: Ipsen Industries International Gesellschaft mit beschrankter Haftung, Kleve, Fed. Rep. of Germany

[21] Appl. No.: 596,700

[22] Filed: Oct. 12, 1990

[30] Foreign Application Priority Data

Oct. 12, 1989 [DE] Fed. Rep. of Germany ..... 3934103

[51] Int. Cl.[5] ..... F27B 5/04; C21D 1/74; C21D 1/06

[52] U.S. Cl. ..... 432/205; 432/128; 432/207; 432/226; 266/250; 266/258; 266/274; 219/390

[58] Field of Search ..... 432/56, 57, 77, 80, 432/81, 83, 86, 121, 128, 152, 200, 202, 205, 207, 208, 241, 253, 226, 245; 266/250, 258, 274; 219/390

[56] References Cited

U.S. PATENT DOCUMENTS

| | | | |
|---|---|---|---|
| 3,399,875 | 9/1968 | Ipsen | 432/205 X |
| 3,447,788 | 6/1969 | Bornor | 432/205 X |
| 3,718,324 | 2/1973 | Westeren et al. | 266/250 |
| 3,801,079 | 4/1974 | Limque et al. | 266/250 X |
| 4,417,722 | 11/1983 | Ishii et al. | 266/250 |
| 4,430,055 | 2/1984 | Sugiyama | 432/205 X |
| 4,462,577 | 7/1984 | Westeren | 266/250 |
| 4,518,353 | 5/1985 | Banno et al. | 432/205 |
| 4,653,732 | 3/1987 | Wunning et al. | 266/250 |
| 4,682,011 | 7/1987 | Hoffmann et al. | 219/390 |
| 4,911,415 | 3/1990 | Lohse et al. | 266/274 |

FOREIGN PATENT DOCUMENTS

| | | | |
|---|---|---|---|
| 2426877 | 1/1980 | France | 432/205 |
| 0093230 | 6/1983 | Japan | 432/205 |
| 0382712 | 9/1973 | U.S.S.R. | 432/205 |
| 0588248 | 1/1978 | U.S.S.R. | 432/205 |

*Primary Examiner*—Henry A. Bennet
*Assistant Examiner*—Christopher B. Kilner
*Attorney, Agent, or Firm*—Robert W. Becker & Associates

[57] ABSTRACT

An oven for the partial heat treatment of tools, for example, twist drills, comprises a first section, which contains the heating chamber that is constantly at the desired operating temperature. A second section for the loading and unloading and the quenching is provided. Between the two sections there is arranged a transport device for the charges of tools. The oven may be in the form of a one-chamber or three-chamber vacuum oven. The oven provides a high heat transfer rate, because the heating chamber is constantly at the desired operating temperature and the heat transfer by heat radiation under vacuum is started immediately when the charge is at its final position inside the heating chamber.

16 Claims, 7 Drawing Sheets

(A)
3
4
5
6
7
10
11
12
13
15
16
17
18
19
30
A

OVEN FOR PARTIAL HEAT TREATMENT OF TOOLS

BACKGROUND OF THE INVENTION

The present invention relates to an over or furnace for the partial heat treatment of tools that have a clamping portion and a working portion, whereby the oven comprises a heating chamber that receives charges of tools and is equipped with a door and internal heating elements that irradiate heat for hardening tools under vacuum, at least one evacuating device, a quenching installation, and a charging platform for receiving tools. The clamping portion of the tools that is not to be heated is arranged inside the charging platform and the working portion of the tools that is to be heated is arranged outside the charging platform.

Ovens for a partial heat treatment of tools, for example, for unfinished twist drills made from high speed steel, are known. It is required that the cutting portions of such twist drills are fully hardened while their shaft portion, i.e., their clamping portion, they should be soft. The transition zone between the two portions should be minimal. This is achieved by converting the material of the cutting portion into austenite at temperatures from 1140° C. to 1300° C., depending on the high speed steel used, and subsequent quenching. At the same time, the shaft portion may not be heated above 850° C.

In an oven of the prior art for the partial heat treatment the hardening step is carried out under vacuum. The tools, for example, unfinished twist drills, are inserted into a solid charging platform, usually made from steel and having a high heat-retaining capacity, and are subsequently introduced into a vacuum oven. Then the oven containing the charge of tools is evacuated and heated. The portions of the tools that are extending past the charging platform, i.e., the cutting portion of the twist drill, are heated by the radiation of the heating elements to the temperature at which the conversion to austenite takes place, while the portions inside the charging platform, i.e., the shaft of the unfinished twist drill, is shielded from the radiation. The large mass of the charging platform prevents the shaft portion from being heated to temperatures above 850° C.

These known ovens have the disadvantage, that the heating and cooling period are very time consuming and also result in expansive transition zones between the hardened and the soft portions. Also, all the oven parts in the heating chamber such as the heating elements and the heating connections, the insulation and the charging platform must be heated during the initial heating step and cooled in the subsequent quenching step. This results in a very time consuming process and in high energy losses. The "efficiency" of such an oven with respect to the ratio of the loaded tools to the oven size and mass is extremely low. Also, the productivity of such an oven is very low, i.e., the output per hour versus the operating and purchasing costs is low, resulting in high manufacturing costs per piece.

It is therefore an object of the present invention to provide an efficient and productive oven for the partial heat treatment of tools under vacuum, which especially minimizes the transition zone between the hardened and the soft portions of the tool.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
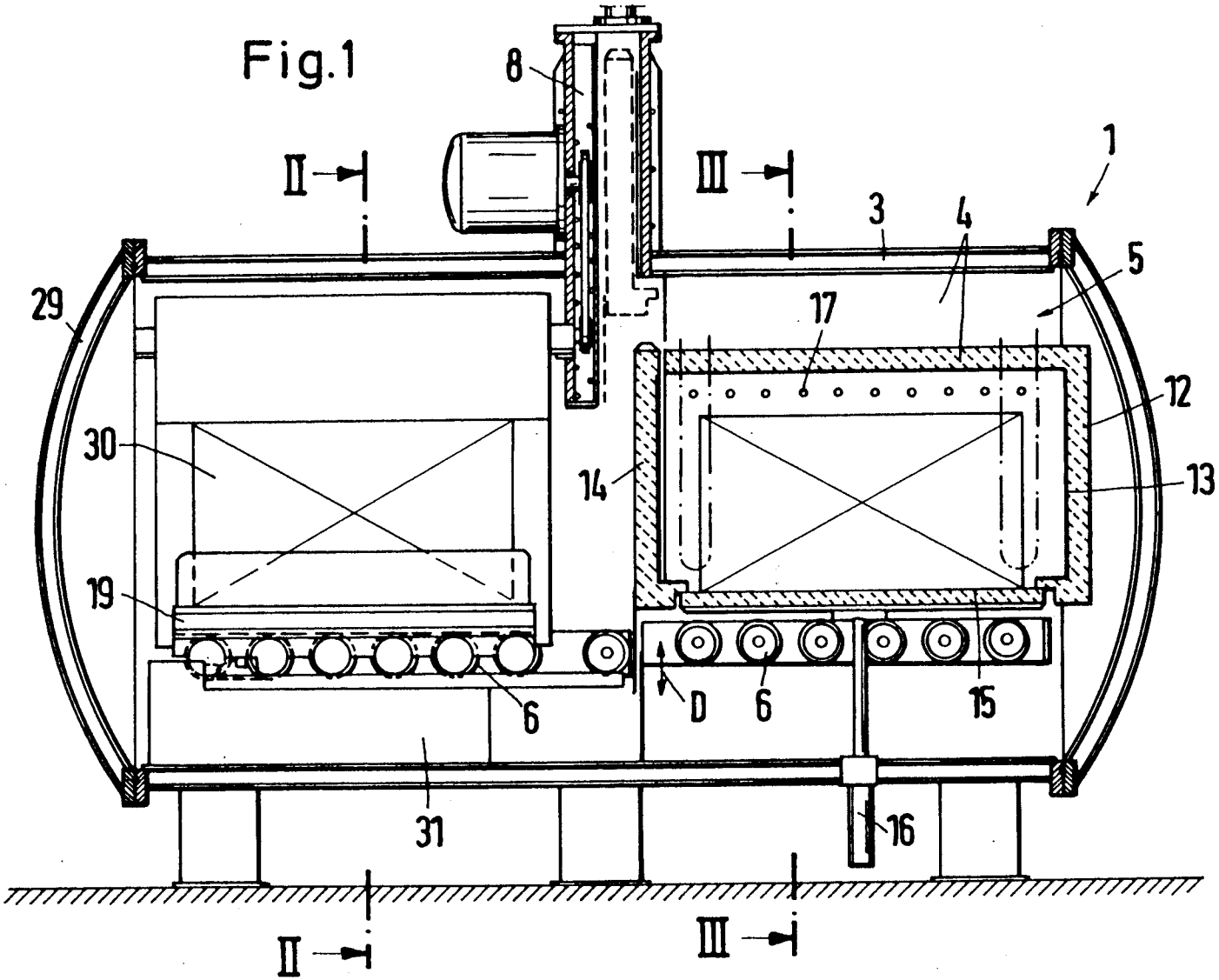
FIG. 1 is a cross-sectional view in the longitudinal direction of a first embodiment of the oven of the present invention in the from of an one-chamber vacuum oven.

The oven of the present invention for the partial heat treatment of tools is primarily characterized by having a first section in which the heating chamber is disposed that is constantly maintained at operating temperature, and a second section for loading, unloading and quenching, with a transport device arranged for the charges of tools between the first and the second section.

With an oven according to the present invention, it is possible to achieve very small transition zones between the hardened and the soft portions of the tools in an economic and inexpensive process. The tools are moved under vacuum from the cold section of the oven into the heated section, i.e., the heating chamber, which is already at the operation temperature. When the charge of tools reaches the heating chamber, the heat transfer by radiation from the heating chamber to the tools is immediately effective. Thereby a high heat transfer efficiency is assured which allows for the fast heating of the tool portions to be hardened so that the core of the portions reaches the desired operating temperature in a few minutes. The tools may then be removed from the heating chamber and may be quenched in the cold section of the oven. The short time span that is required for the heat transfer ensures, that the amount of heat transferred along the drill axis into the shielded shaft of the unfinished twist drill is minimal, so that the shaft portion stays cold and remains in its initial state, i.e. soft.

In a preferred embodiment the oven is comprised of a one-chamber vacuum oven, which essentially consists of two portions. The first portion is the cold section of the oven, which contains the charge of tools during the evacuation step and the quenching step and also serves as the loading and unloading zone. The second portion is the heated section which comprises the heating chamber.

An alternative to the one-chamber vacuum oven is preferably a multi-chamber vacuum oven wherein the first and the second section are disposed in separate chambers. The chambers are separated from one another by vacuum-tight and thermally insulating intermediate doors. The two sections of the oven are therefore formed by separate chambers that are independent from one another.

A multi-chamber vacuum oven is preferably in the form of a three-chamber vacuum oven, which has sequentially arranged an ante-chamber, a main chamber comprising a heating chamber, and a quenching chamber. Each on of the chambers is provided with an evacuating device. The chambers are separated from each other by thermally insulating and vacuum-tight intermediate doors. The ante-chamber serves exclusively for loading the oven, purging and evacuating, whereby, before the charge of tools is loaded into the following main chamber, the ante-chamber is evacuated to the same operating pressure that is present in the main chamber. In its heated state, the heating chamber remains constantly under vacuum. Therefore, the materials used for the insulation and the heating elements must not be oxidation resistant at high temperatures. The materials used in the heating chamber are usually graphite or molybdenum. The quenching chamber is provided with a fan and a heat exchanger for the cooling of the gases. These two elements may also be provided as external units. The quenching chamber is additionally provided with a transport device, which is identical to the one of the ante-chamber.

In a further embodiment, the casing of the heating chamber is provided with a high temperature resistant insulation. If the heating chamber is not under vacuum at all times while heated to high temperatures, an oxidation resistant insulation must be employed. At the inner side of the casing, there are also arranged high temperature resistant and, if necessary, oxidation resistant heat-retaining plates with high heat emission properties. The design of this heating chamber ascertains optimal heating and heat retaining properties. While the insulation, comprising, for example, aluminum oxide fibers, serve to thermally insulate the heating chamber to the outside, the heat retaining plates, comprising, for example, silicium carbide fibers, provide the required immediate heat radiation, when the charge of tools is loaded into the heating chamber. The insulation and the heat retaining plates must be of an oxidation resistant material only when they may come into contact with air. This is the case for a one-chamber vacuum oven, but not for a three-chamber vacuum oven, in which the chambers may be evacuated independently. The heating elements may be arranged at the top, or at the top and the sides, of the heating chamber. They consist also of a high temperature resistant and, if necessary, oxidation resistant and vacuum resistant heating element material, for example, Kanthal (produced by Bulten-Kanthal, 73401 Hellstahammar, Sweden).

In a further preferred embodiment of the heating chamber of the present invention the heating chamber is equipped with a bottom hatch that is provided with a raising and lowering mechanism. The bottom hatch is made from insulation material. The charging platform consists of an insulation plate, on which a radiation shield is arranged. The charging platform is movable between the heating chamber and the bottom hatch via the transport device. In its operating position, the charging platform replaces the bottom hatch which is then in its lowered position. The bottom hatch consists preferably of the same insulation material as the casing of the heating chamber, but is not equipped with heat retaining plates, because, in the operating mode of the heating chamber, the bottom hatch is lowered and replaced by the charging platform so that it would radiate heat without any useful effect outside the heating chamber. The insulation plate of the bottom hatch may comprise, for example, ceramic fibers. A further movable element of the heating chamber is an insulated door for the loading and unloading of the charge of tools. The inside of the door, however, is equipped with heat retaining plates. The radiation shield arranged on the insulation plate of the charging platform reduces, due to reflection, the heat transfer onto the charging platform.

The charging platform is also equipped with a lowering and raising mechanism, so that the charging platform, after it has been positioned below the heating chamber, may be pressed against the casing of the heating chamber in order to prevent that heat is lost by radiation through slots to the cold section of the oven. In a further embodiment the insulation plate with the radiation shield is arranged on a base plate. This arrangement increases the stability of the charging platform as a whole.

The radiation shield and the insulation plate and in addition the base plate may be provided with borings for receiving the tools. When the borings go through the base plate, then there is provided a bottom plate, below the borings and spaced at a distance. The distance may be varied via adjusting means. Thereby the depth to which the tool is inserted into the boring may be adjusted.

The bottom plate, on its outer side facing away from the tools, may also be equipped with a radiation shield, that will reduce the heat transfer from the bottom hatch below to the bottom plate.

In a further embodiment the cold section of the oven is provided with heat exchange elements, which serve to cool the gases.

DESCRIPTION OF PREFERRED EMBODIMENTS

The present invention will now be described in detail with the aid of several specific embodiments utilizing FIGS. 1 through 9.

FIGS. 1 through 5 represent a first embodiment of an oven or furnace for the partial heat treatment of tools in the form of a one-chamber vacuum oven 1. FIGS. 6 through 9 show a second embodiment in the form of a three-chamber vacuum oven 2.

Figures 3, 4:
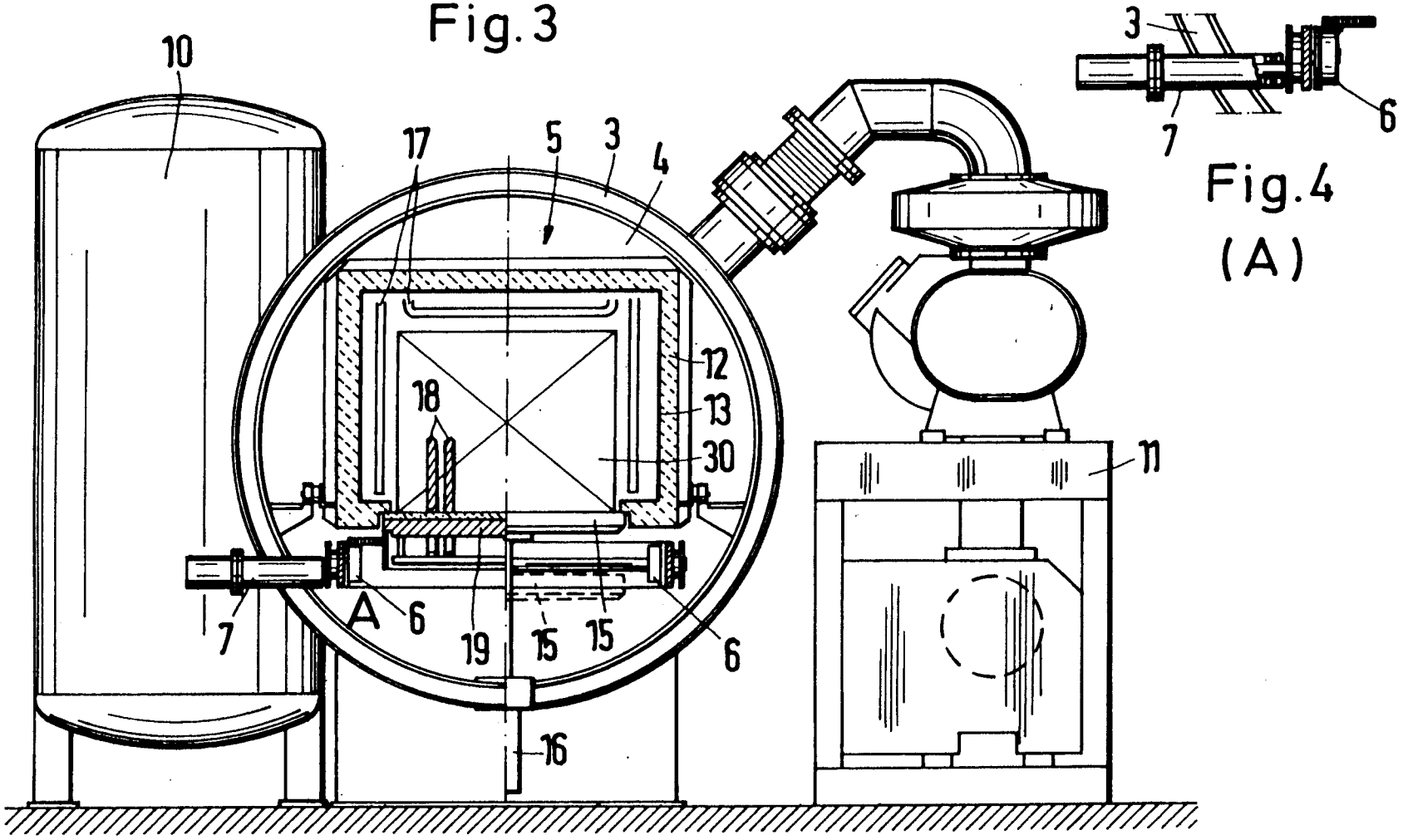
FIG. 3 is a cross-sectional view of the heating chamber of the oven, along the lines III—III in FIG. 1.
FIG. 4 shows a detail of FIG. 3.

The one-chamber vacuum oven of the first embodiment comprises a casing 3 which defines an oven chamber 4. The oven chamber 4 is divided into two section, one cold section (on the left in FIG. 1) and a heated section (on the right in FIG. 1). In the heated section, there is provided a heating chamber 5, in which the partial heat treatment is carried out. The two sections are connected via a transport device in the form of a roll table 6 which in the heated section with the heating chamber 5 may be raised and lowered via an eccentric drive 7 (as represented by the double headed arrow D in FIG. 1). Between the two sections there are two cooling fans 8 arranged. In addition, the sides of the cold section of the one-chamber vacuum oven 1 is provided with heat exchange elements 9. In FIG. 3, there is also shown a working tank 10 and an evacuating device 11.

The heating chamber 5 has a casing comprising an insulation 12, which consists of a high temperature resistant and oxidation resistant insulation material, for example, aluminum oxide fibers. On the inside of the insulation 12 there are plates 13 arranged which are also high temperature and oxidation resistant as well as heat retaining. They consist of a material that has a high heat emission, for example, silicium carbide plates. The heating chamber 5 is equipped with a door 14 facing the cold section of the one-chamber vacuum oven 1 which may be opened, in a slidable or in a hinged fashion, to the side or to the top. The door is also provided with insulation 12 and heat retaining plate s 13 like the heating chamber 5. The bottom of the heating chamber 5 is formed by a bottom hatch 15, which consist of the same insulation material as the insulation 12, but is not equipped with heat retaining plates 13. The bottom hatch 15 may be raised and lowered above or below the roll table 6 via a raising and lowering device 16, as shown as a dotted line on the right side of FIG. 3.

The inside of the heating chamber 5 is equipped with heating elements 17 on the top or the sides, which consist of high temperature and oxidation resistant and vacuum resistant heating element material, for example Kanthal.

Figure 5:
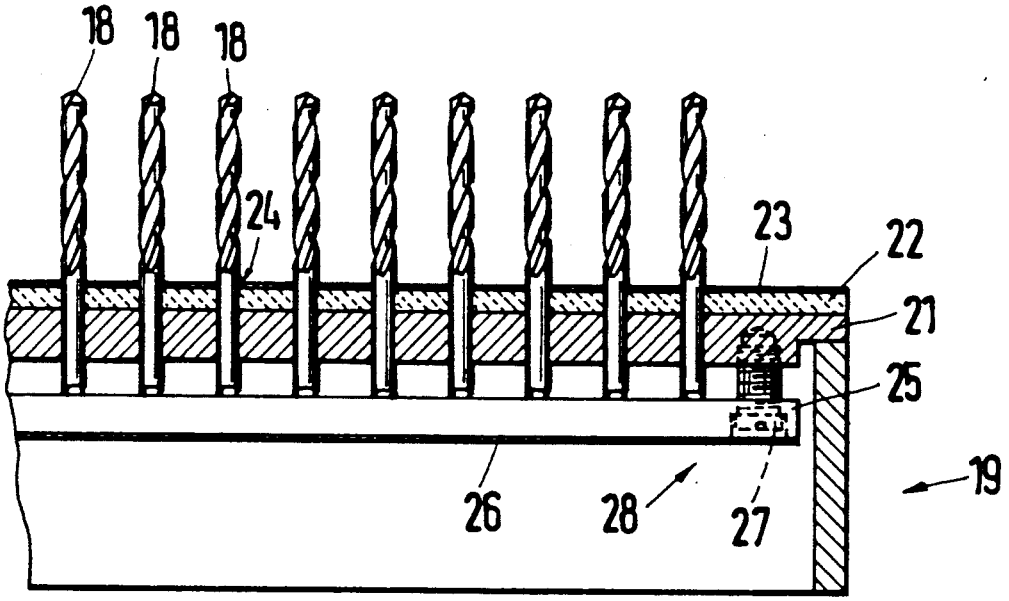
FIG. 5 shows a cross-sectional view of the charging platform of the oven.
Figure 6:
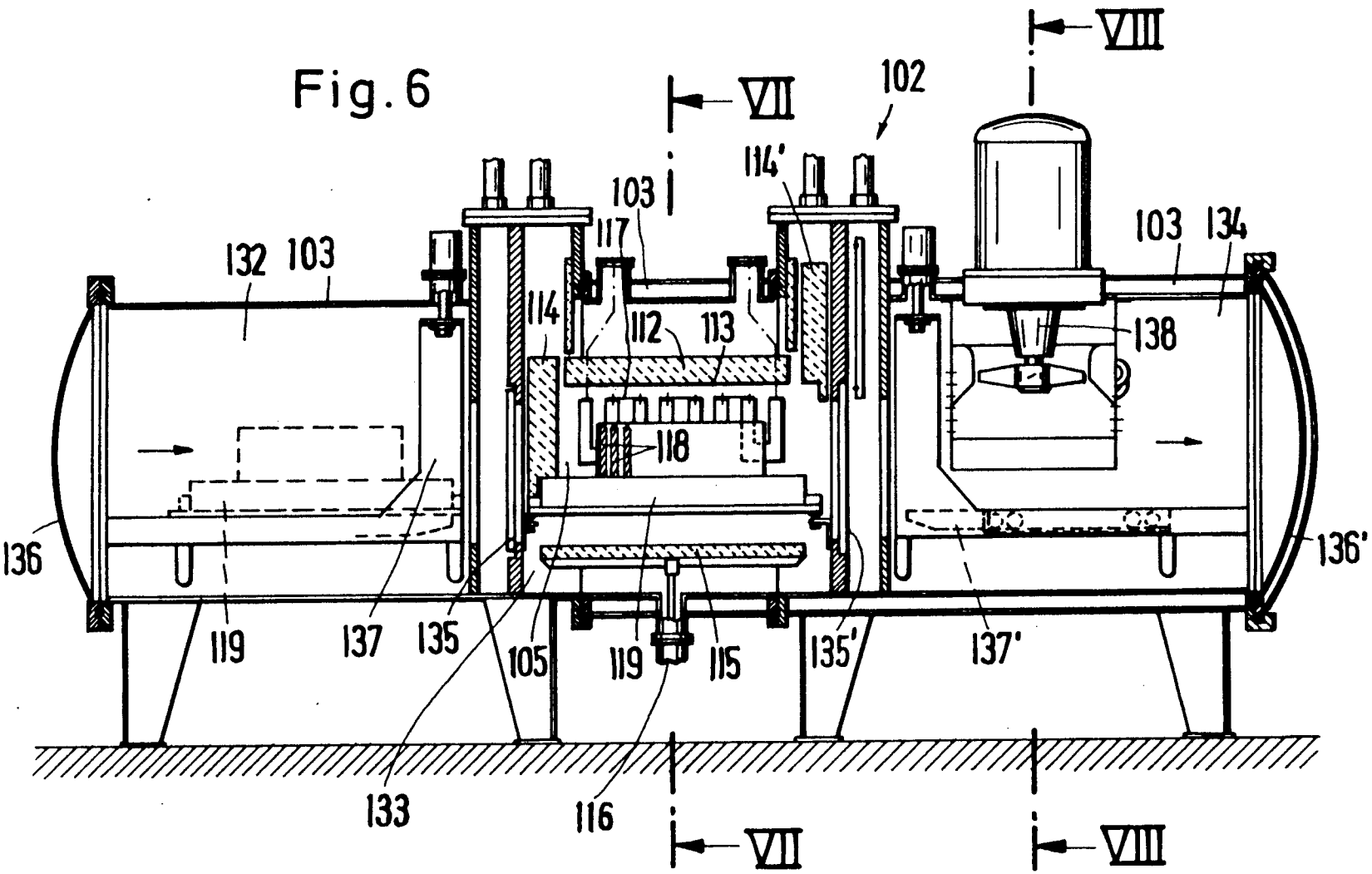
FIG. 6 is a cross-sectional view in the longitudinal direction of a second embodiment in the form of a three-chamber vacuum oven.
Figure 8:
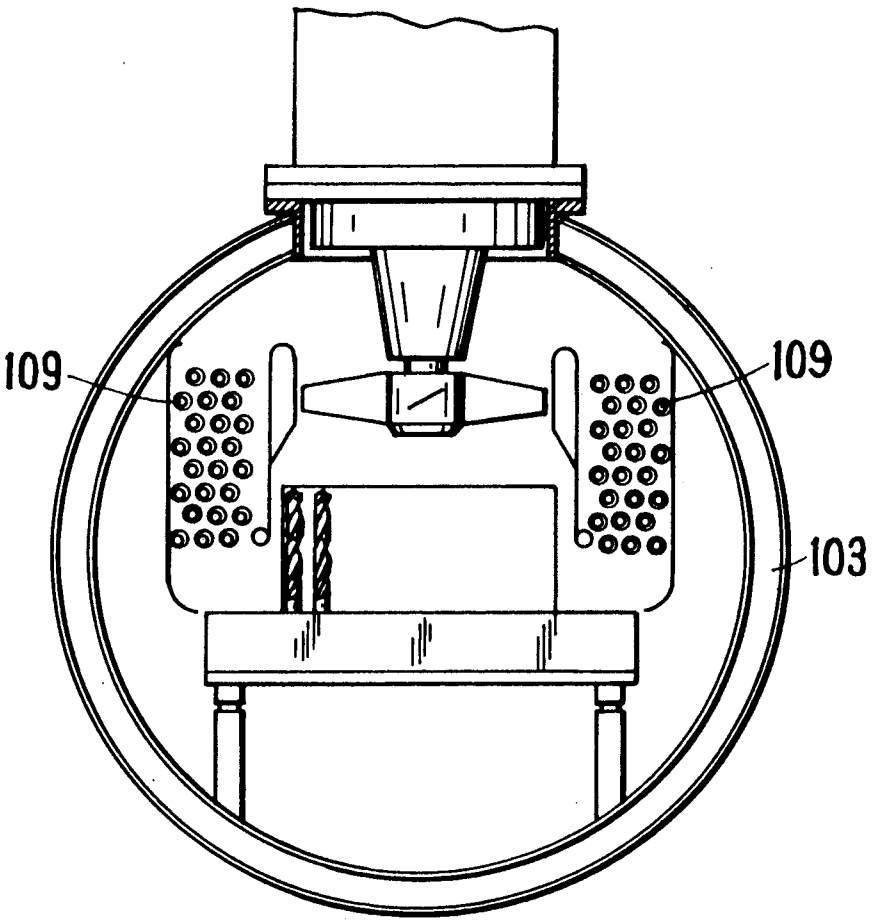
FIG. 8 is a cross-sectional view of the quenching chamber, along the lines VIII—VIII in FIG. 6.
Figure 7:
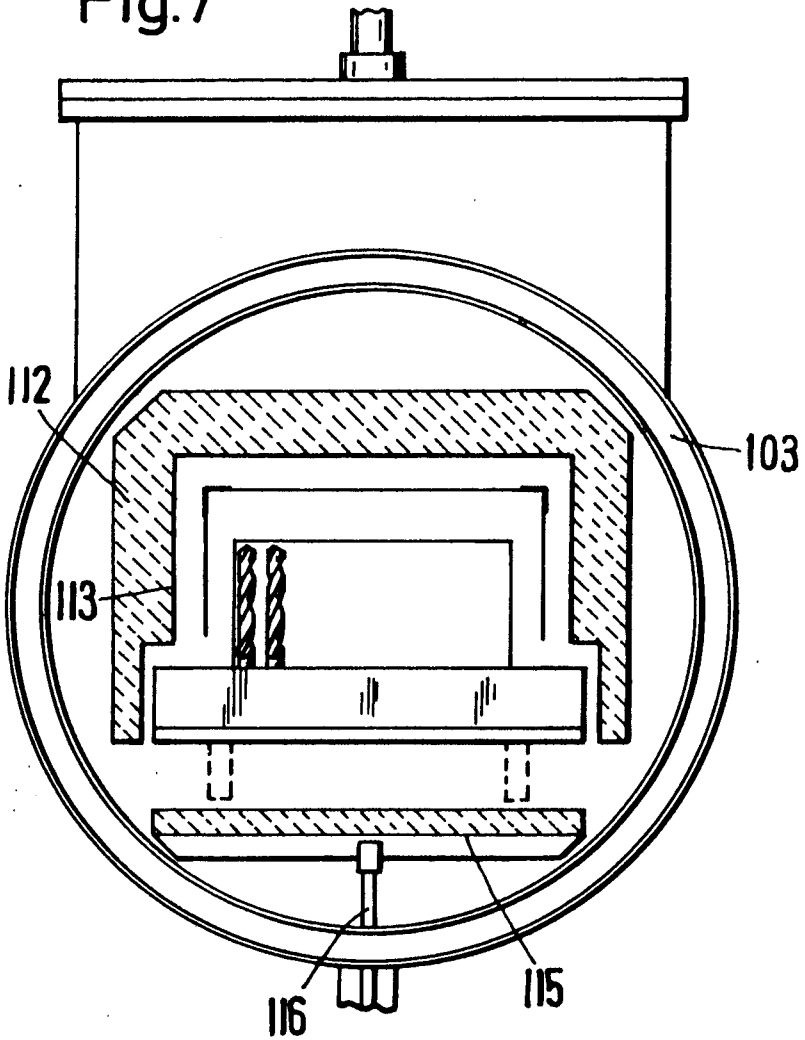
FIG. 7 is a cross-sectional view of the heating chamber, along the lines VII—VII in FIG. 6.
Figure 9:
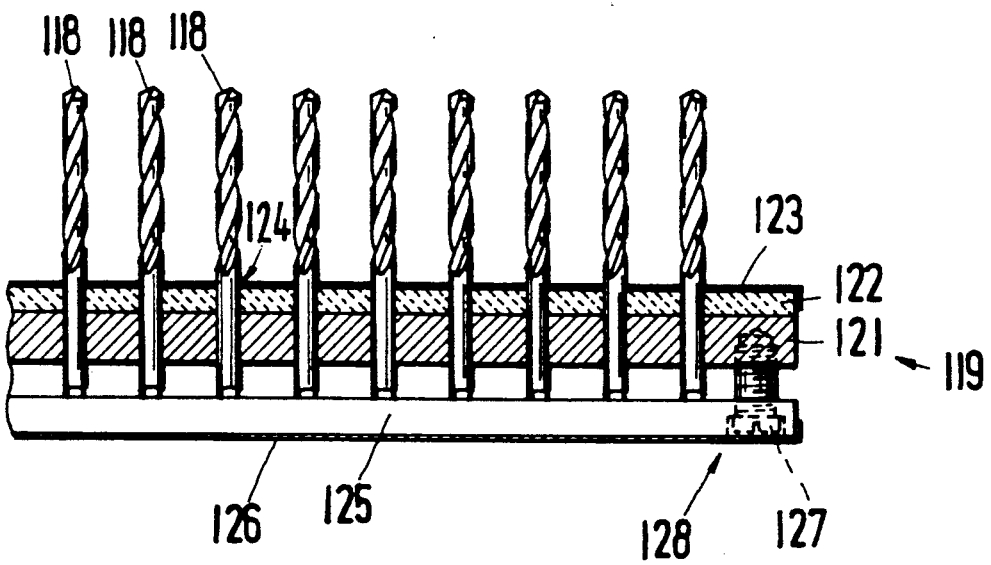
FIG. 9 shows a cross-sectional view of the charging platform of the three-chamber vacuum oven.

A charging platform 19 serves for receiving the tools 18 which are to be heat treated, which is represented in detail in FIG. 5.

This charging platform 19 comprises a rectangular transport frame 20, which supports a base plate 21, for example made from steel. Onto the base plate 21 an insulation plate 22 is arranged which consists of, for example, consisting of aluminum oxide fibers. The insulation plate 22 reduces the heat transfer to the base plate 21. Onto the insulation plate 22, a radiation shield 23 is arranged, which may be made from, for example, a polished metal sheet or a foil with a low heat emission factor, i.e., a high reflection. The material used may be, for example, NiCr material. This assembly, comprising a base plate 21, an insulation plate 22 and a radiation shield 23, is provided with borings 24 for receiving the tools 18, for example, unfinished twist drills. Below this assembly, a bottom plate 25 is arranged which is also provided with a radiation shield 26 at its bottom side. The radiation shield 26 may consist of the same materials as the radiation shield 2. The bottom plate 25 is connected to the radiation shield 26 via threaded bolts 27, that are fastened to the base plate 21 and which define adjusting means 28 with which the bottom plate 25 is adjustable in order to vary the depth with which the tools 18 are inserted into the assembly.

Figure 2:
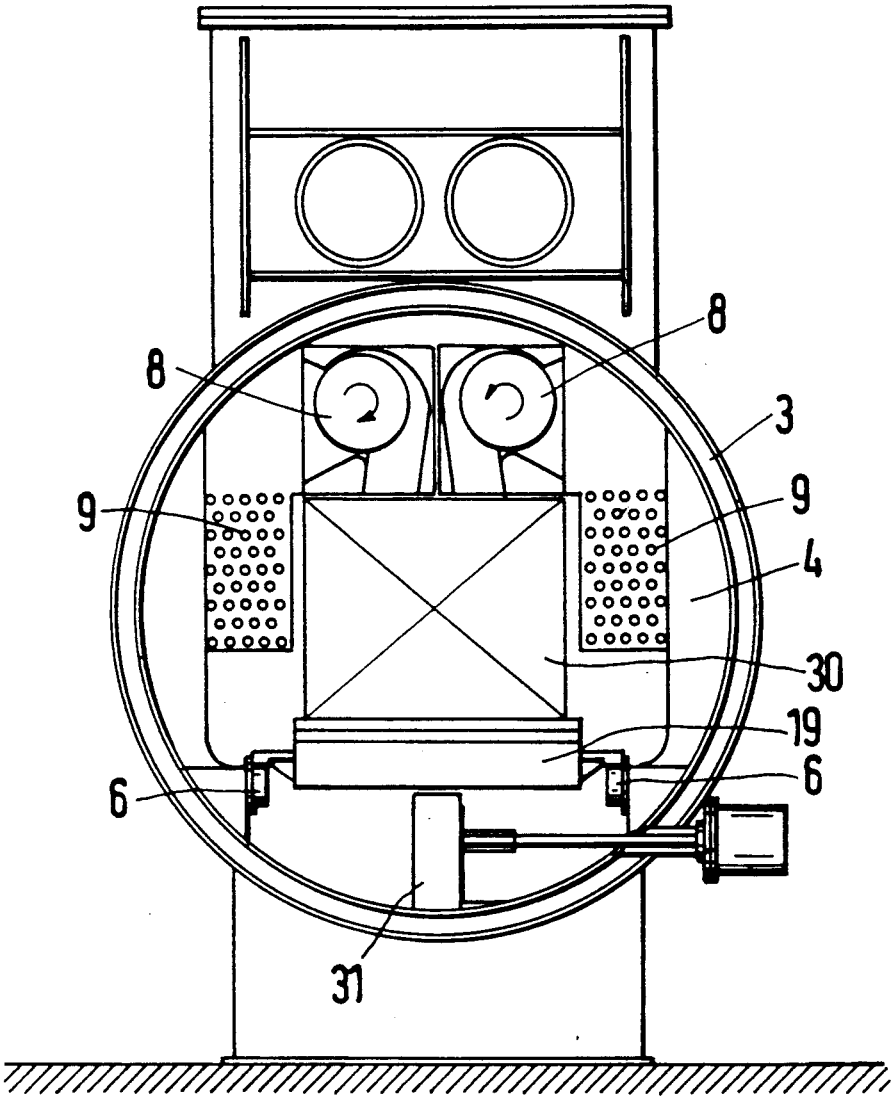
FIG. 2 is a cross-sectional view of the cold section of the oven, along the lines II—II in FIG. 1.

The one-chamber vacuum oven operates as follows: After the oven door 29 is opened, the charge 30 of tools 18 is introduced into the cold section of the oven 1, whereby the transport frame 20 of the charging device 19 rests on the roll table 6, as shown in FIG. 2. The transport frame 20 may be made from cast iron and may have guide bars with a finished bottom face at its longitudinal sides. During the loading procedure the heating chamber 5 of the one-chamber vacuum oven is already heated to the desired operating temperature, whereby the bottom hatch is closed, as represented by the solid lines in FIG. 3. On the right side of FIG. 3, the heating chamber 5 is shown without a charge 30 of tools 18.

After the door 29 has been closed, the oven chamber 4 is evacuated. Subsequently, the door 14 of the heating chamber 5 is opened and the bottom hatch 15 is lowered via the raising and lowering device 16. The charging platform 19 is then moved into the heating chamber via the roll table 6, whereby a push-pull chain device 31 engages the charging platform. After the charging platform 19 has reached its final position relative to the heating chamber 5, the door 14 is closed and the roll table 6 is raised via the eccentric drive 7 such that the charging platform 19 closes the bottom of the heating chamber 5, thereby replacing the bottom hatch 15. In this position the heat treatment may be carried out. The heat treatment is actually starting as soon as the charging platform 19 reaches the closing position, because the heating chamber 5 is already at the required operating temperature.

After the heat treatment has been completed, the door 14 is opened and the roll table 6 is lowered and then removed from the heat chamber 5 via the push-pull chain device 31 of the charging platform 19. The door 14 is closed immediately afterwards and the bottom hatch 15 is raised to close the bottom opening, so that the heating chamber 5 is enclosed from all sides and no heat loss occurs. The cooling fans 8 are then actuated in order to quench the charge 30 in the left section of the oven chamber 4. When the quenching step is finished, the oven casing is flushed with gas and the door 29 opened to remove the charge 30 from the oven.

A second embodiment of the present invention is the three-chamber vacuum oven 102 represented in FIGS. 6 through 9. It comprises three-chambers: one ante-chamber 132, an adjacent main chamber 133, which contains a heating chamber 105, and a subsequent quenching chamber 134. These three chambers 132, 133, 134 are separated from each other by thermally insulating and vacuum-tight intermediate doors 135. Each chamber 132, 133, 134 is equipped with its own evacuating device.

The ante-chamber 132 is equipped with an oven door 136 and a telescope loading device 137 inside the chamber 132.

The main chamber 133 contains the heating chamber 105 which is essentially identical to the one of the one-chamber vacuum oven 1. However, the insulation material and the material for the heating elements must not be oxidation resistant at high temperatures, because the heating chamber 105 in its heated state is under vacuum at all times. Therefore, graphite and molybdenum is commonly used as insulation material for the heating chamber 105 of the three-chamber vacuum oven 102 of the second embodiment. For the transport of the charge 130 of tools 118 into the main chamber 133 and the heating chamber 105 there is provided a telescope loading device 137, which comprises a raising and displacing device that is attached to a frame that also may be raised and lowered. The heating chamber 105 of the second embodiment is also equipped with a second door 114', which is opposite the first door 114 and opens to the adjacent quenching chamber 134.

The quenching chamber 134 is equipped with a telescope loading device 137' and, most importantly, with a cooling fan 138 and, on its sides, with heat exchange elements 109. For the removal of the charge 130 of tools 118 from the quenching chamber 134, a second oven door 136' is provided.

The three-chamber vacuum oven operates as follows: The charge 130 to be finished is loaded into the ante-chamber 132 with the charging platform 119. The charging platform 119 shown in FIG. 9 differs from the charging platform 19 of the first embodiment only in that it is not provided with a transport frame such as the transport frame 20, because a telescope loading device is provided as a transport means in the second embodiment. The two charging platforms are identical otherwise. After the charging platform 119 has been introduced into the ante-chamber 132 via an external loading device the oven door 136 is closed in a vacuum-tight manner. The intermediate doors 135, 135' between the chambers 132, 133 and 133, 134 are also closed. Thereby the main chamber 133 may be under vacuum at all times and the contained heating chamber 105 may be maintained at the desired operating temperature. Then the ante-chamber 132 is evacuated to achieve the same vacuum as the one present in the main chamber 133. When the desired vacuum is reached, the vacuum-tight and thermally insulated intermediate door 135 is opened and the bottom hatch 115 of the heating chamber 105 is lowered. After the left door 114 of the heating chamber 105 is opened, the charging platform 119 is moved into the main chamber 133 to its desired position at the heating chamber via the telescope loading device 137. When the charging platform 119 has reached its final position, the door 114 and the intermediate door 135 are closed. After the charging platform 119 has assumed the position of the bottom hatch 115 of the heating chamber 105 and has sealed it tightly, the heating process of the portions of the tools 118 which extend past the charging platform 119 begins.

After the conversion to austenite is complete the right door 114' of the heating chamber 105 and the vacuum-tight and thermally insulating intermediate door 135' to the quenching chamber 134 are opened. The charge 130 is then transported into the quenching chamber 134 via the telescope loading device 137'. The door 114' of the heating chamber 105 and the intermediate door 135' are closed and the bottom hatch 115 is raised to close the bottom portion of the heating chamber 105. The quenching chamber 134 is then filled with gas. The gas pressure may be adjusted to a desired value, whereby a pressure higher than atmospheric pressure is possible. The cooling fan 18 is then switched on in order to cool the charge 130 down to a temperature of preferably less than 150° C. Then the door 136' of the quenching chamber 134 is opened and the charge 130 is removed from the quenching chamber 134 via an external unloading device.

During the complete treatment process the heating chamber 105 is maintained under vacuum and at the desired operating temperature, so that an immediate heat transfer to the tools 118 to be treated is achieved.

The present invention is, of course, in no way restricted to the specific disclosure of the specification, examples and drawings, but also encompasses any modifications within the scope of the appended claims.

What we claim is:

1. In a furnace for a partial heat treatment of tools having a clamping portion and a working portion, said furnace comprising a heating chamber that receives charges of tools and is equipped with a door and internal heating elements that irradiate heat for hardening of said tools under vacuum; at least one evacuating device; a quenching installation; and a charging platform for receiving tools whereby said clamping portion of said tools that is not to be heated is arranged inside said charging platform and said working portion of said tools that is to be heated is arranged outside said charging platform the improvement wherein:

said furnace has a first section in which said heating chamber is disposed which heating chamber is constantly maintained at operating temperature; and a second section for loading, unloading and quenching; with a transport device for said charges arranged between said first and said second section;

said furnace is a three-chamber vacuum furnace having three chambers wherein said first section is disposed in a first chamber and said second section is disposed in a second and a third chamber; with said first chamber such that, in sequence, said second chamber is an ante-chamber, said first chamber is a main chamber containing said heating chamber, and said third chamber is a quenching chamber; with a first pair of vacuum-tight and thermally insulating intermediate doors separating said second chamber from said first chamber and with a second pair of vacuum-tight and thermally insulating intermediate doors separating said first chamber from said third chamber, wherein each of said chambers is provided with an individual one of said evacuating devices.

2. An oven according to claim 1 in which said heating chamber has a casing that comprises a high temperature resistant insulation, whereby an inner side of said insulation is equipped with high temperature resistant plates having good heat insulating properties.

3. An oven according to claim 2 in which said insulation and said plates are high temperature and oxidation resistant.

4. An oven according to claim 2 in which said heating chamber has a bottom hatch that includes insulating material and is provided with a raising and lowering mechanism, with said charging platform comprising an insulation plate, that is equipped with a radiation shield, and with said charging platform being movable between said bottom hatch and said heating chamber, via said transport device, whereby, in the operating position, said charging platform replaces said lowered bottom hatch.

5. An oven according to claim 4 in which said charging platform is provided with a lowering and raising mechanism.

6. An oven according to claim 4 in which said insulation plate with said radiation shield is arranged on a base plate.

7. An oven according to claim 6 in which said radiation shield, said insulation plate and said base plate are provided with borings for receiving said tools.

8. An oven according to claim 7 in which said radiation shield, said insulation plate and said base plate are provided with through borings for receiving said tools with a further bottom plate being arranged, below and at a distance from said borings, to provide a rest for said tools, which bottom plate is equipped with means for adjusting said distance.

9. An oven according to claim 8 in which said further bottom plate has a further radiation shield on an outer side, facing away from said tools.

10. An oven according to claim 1 in which heat exchange elements are arranged in a cold section of said oven.

11. In an oven for a partial heat treatment of tools having a clamping portion and a working portion, said oven comprising a heating chamber that receives charges of tools and is equipped with a door and internal heating elements that irradiate heat for hardening of said tools under vacuum; at least one evacuating device; a quenching installation; and a charging platform for receiving tools whereby said clamping portion of said tools that is not to be heated is arranged inside said charging platform and said working portion of said tools that is to be heated is arranged outside said charging platform the improvement wherein:

said oven has a first section in which said heating chamber is disposed which heating chamber is constantly maintained at operating temperature; and a second section for loading, unloading and quenching; with a transport device for said charges arranged between said first and said second section;

said heating chamber has a casing that comprises a high temperature resistant insulation, whereby an inner side of said insulation is equipped with high temperature resistant plates having good heat insulating properties; and said heating chamber has a bottom hatch that includes insulating material and is provided with a raising and lowering mechanism, with said charging platform comprising an insulation plate, that is equipped with a radiation shield, and with said charging platform being movable between said bottom hatch and said heating chamber, via said transport device, whereby, in the operating position, said charging platform replaces said lowered bottom hatch.

12. An oven according to claim 11 in which said charging platform is provided with a lowering and raising mechanism.

13. An oven according to claim 11 in which said insulation plate with said radiation shield is arranged on a base plate.

14. An oven according to claim 13 in which said radiation shield, said insulation plate and said base plate are provided with borings for receiving said tools.

15. An oven according to claim 14 in which said radiation shield, said insulation plate and said base plate are provided with through borings for receiving said tools with a further bottom plate being arranged, below and at a distance from said borings, to provide a rest for said tools, which bottom plate is equipped with means for adjusting said distance.

16. An oven according to claim 15 in which said further bottom plate has a further radiation shield on an outer side, facing away from said tools.

* * * * *